US010343427B2

(12) United States Patent
Mori et al.

(10) Patent No.: US 10,343,427 B2
(45) Date of Patent: Jul. 9, 2019

(54) MEDIUM TRANSPORT DEVICE AND RECORDING APPARATUS

(71) Applicant: SEIKO EPSON CORPORATION, Tokyo (JP)

(72) Inventors: Kazunori Mori, Nagano (JP); Yosaku Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/859,882

(22) Filed: Jan. 2, 2018

(65) Prior Publication Data

US 2018/0207961 A1 Jul. 26, 2018

(30) Foreign Application Priority Data

Jan. 25, 2017 (JP) ..... 2017-010936

(51) Int. Cl.

| | |
|---|---|
| ***B41J 13/00*** | (2006.01) |
| ***B41J 2/21*** | (2006.01) |
| ***B41J 2/045*** | (2006.01) |

(52) U.S. Cl.

CPC ..... *B41J 13/0009* (2013.01); *B41J 2/04573* (2013.01); *B41J 2/2146* (2013.01); *B41J 13/0027* (2013.01)

(58) Field of Classification Search

CPC ..... B41J 13/0009

See application file for complete search history.

(56) References Cited

U.S. PATENT DOCUMENTS

| | | | | |
|---|---|---|---|---|
| 2008/0050164 | A1 | 2/2008 | Yanagi et al. | |
| 2008/0252676 | A1* | 10/2008 | Yasutani | B41J 29/38 347/16 |
| 2008/0252677 | A1* | 10/2008 | Tajika | B41J 11/42 347/16 |
| 2014/0078207 | A1* | 3/2014 | Ishida | B41J 13/0027 347/16 |
| 2014/0078210 | A1* | 3/2014 | Ishida | B41J 11/46 347/16 |

FOREIGN PATENT DOCUMENTS

| | | |
|---|---|---|
| JP | 2001-341911 A | 12/2001 |
| JP | 2008-049555 A | 3/2008 |

* cited by examiner

*Primary Examiner* — Shelby L Fidler

(57) ABSTRACT

A recording apparatus which suppresses banding which occurs on a recording surface of a medium.

12 Claims, 11 Drawing Sheets

MEDIUM TRANSPORT DEVICE AND RECORDING APPARATUS

BACKGROUND

1. Technical Field

The present invention relates to a medium transport device which transports a medium and a recording apparatus which performs recording on the medium.

2. Related Art

A recording apparatus which is represented by a printer, an image reading apparatus which is represented by a scanner, or the like is provided with a medium transport device which transports paper as a medium.

There is a medium transport device which is provided with a transport roller pair which feeds the medium toward a processing unit on an upstream side of the processing unit such as a recording unit in a printer or an image reading unit in a scanner and is provided with an output roller pair which feeds the medium in an output direction on a downstream side of the processing unit. The transport roller pair and the output roller pair are configured to include drive rollers which are driven by a drive source and driven rollers which are rotationally driven by the rotation of the drive rollers, respectively.

In the medium transport device which is provided with the transport roller pair and the output roller pair, transport drive rollers which are the drive rollers of the transport roller pair and output drive rollers which are the drive rollers of the output roller pair are configured to be driven by a common drive source.

The motive force of the drive source is transmitted to each of the transport drive rollers and the output drive rollers by a motive force transmission mechanism such as a gear train or a belt.

Here, there is a case in which a phenomenon referred to as "kicking" in which the medium is kicked out by a nipping load of transport driven rollers with respect to the transport drive rollers occurs when the rear end of the medium which is transported leaves the transport roller pair. When the transport drive roller pair receives the force of the "kicking" and rotates, the output drive rollers which are connected via the motive force transmission mechanism are also rotated and the "kicking" becomes all the more notable.

Furthermore, ordinarily, in order to suppress the bending of the medium between the transport roller pair and the output roller pair, the output drive rollers are set to an increased speed in comparison to the transport drive rollers and the medium may move all the more to the extent that the amount by which the transport drive rollers are rotated by the "kicking" is multiplied by a speed increasing ratio. When the medium moves due to the "kicking", for example, in the printer, there is a case in which so-called banding in which recording irregularities are visible as white lines occurs.

In order to suppress the banding which originates from the "kicking" of the medium in the transport roller pair, in JP-A-2008-49555, a technique of rendering the banding less apparent by providing encoders in both the transport roller pair and the output roller pair and comparing and correcting the transport amounts of the transport roller pair and the output roller pair to each other is disclosed.

JP-A-2001-341911 describes an increase in a medium transport speed when the rear end of the medium leaves the transport roller pair. Specifically, when the medium is gripped by both the transport roller pair and the output roller pair, back tension acts on the output roller pair which is set to an increased speed as compared to the transport roller pair, the shaft of the output roller pair bends, and when the rear end of the medium leaves the transport roller pair, a returning force of the bending of the shaft acts on the medium and the medium transport speed increases.

In JP-A-2001-341911, by restricting the bending of the shaft of the output roller pair, an increase in the medium transport speed which occurs when the rear end of the medium leaves the transport roller pair is suppressed.

JP-A-2008-49555 is a technique of rendering the banding which occurs due to the "kicking" less apparent using correction and does not suppress the occurrence of the "kicking" or the occurrence of the banding which originates from the "kicking".

JP-A-2001-341911 is a technique of suppressing an increase in the medium transport speed which originates from the bending of the shaft by the back tension in the output roller pair and does not suppress an increase in the "kicking" which originates from the output roller pair being rotated via the motive force transmission mechanism from the transport roller pair by the "kicking".

SUMMARY

An advantage of some aspects of the invention is that an increase in a medium transport speed which originates from a nipping load of transport driven rollers with respect to the transport drive rollers is suppressed and that, accordingly, banding which occurs on a recording surface of the medium is suppressed.

According to an aspect of the invention, there is provided a medium transport device which includes a processing unit which performs a process relating to a medium which is transported, an upstream transport mechanism which is provided on an upstream side of the medium in a transport direction with respect to the processing unit, a downstream transport mechanism which is provided on a downstream side in the transport direction with respect to the processing unit, a first drive source which drives the upstream transport mechanism, a second drive source which drives the downstream transport mechanism, a medium detector which is provided on the upstream side in the transport direction with respect to the upstream transport mechanism and detects a position of an end portion of the medium in the transport direction, and a control unit which controls transporting the medium performed by the upstream transport mechanism and the downstream transport mechanism, in which, based on detection results of the medium detector, the control unit determines a transport state from among a first transport state in which a single sheet of the medium is transported by the upstream transport mechanism and is not transported by the downstream transport mechanism, a second transport state in which the single sheet of the medium is transported by both the upstream transport mechanism and the downstream transport mechanism, and a third transport state in which the single sheet of the medium is transported by the downstream transport mechanism and is not transported by the upstream transport mechanism, and controls the first drive source and the second drive source based on a determination result of the transport state.

An image recording process which records an image on a medium and an image reading process which reads an image which is represented on a medium are examples of processes relating to a medium in the processing unit.

According to this aspect, since the upstream transport mechanism and the downstream transport mechanism are driven by individual drive sources, it is possible to reduce a concern that an increase in the medium transport speed which occurs when the rear end of the medium leaves the upstream transport mechanism (hereinafter, there are cases in which this will be referred to as "kicking") will be transmitted to the downstream transport mechanism. Therefore, it is possible to suppress the occurrence of banding which originates from the kicking.

Furthermore, based on the detection results of the medium detector, the control unit determines a transport state from among the first transport state in which a single sheet of the medium is transported by the upstream transport mechanism and is not transported by the downstream transport mechanism, a second transport state in which the single sheet of the medium is transported by both the upstream transport mechanism and the downstream transport mechanism, and a third transport state in which the single sheet of the medium is transported by the downstream transport mechanism and is not transported by the upstream transport mechanism, and controls the first drive source and the second drive source based on a determination result of the transport state, and thus, high precision transporting becomes possible.

The medium transport device may further include an upstream correction table which is used in correction of a medium transport speed in the upstream transport mechanism, and a downstream correction table which is used in correction of the medium transport speed in the downstream transport mechanism, which are referred to by the control unit, in which when a single sheet of the medium is in the first transport state, the control unit uses the upstream correction table to control the first drive source, in which when the single sheet of the medium is in the second transport state, the control unit uses the upstream correction table to control the first drive source and uses the downstream correction table to control the second drive source, and in which when the single sheet of the medium is in the third transport state, the control unit uses the downstream correction table to control the second drive source.

According to this aspect, when the single sheet of the medium is in the first transport state, the control unit uses the upstream correction table to control the first drive source, when the single sheet of the medium is in the second transport state, the control unit uses the upstream correction table to control the first drive source and uses the downstream correction table to control the second drive source, and when the single sheet of the medium is in the third transport state, the control unit uses the downstream correction table to control the second drive source, and thus, higher precision transporting becomes possible.

In the medium transport device, the upstream transport mechanism may be configured to include an upstream side drive roller which is driven by the first drive source and an upstream side driven roller which contacts the upstream side drive roller and is driven to rotate, the downstream transport mechanism may be configured to include a downstream side drive roller which is driven by the second drive source and a downstream side driven roller which contacts the downstream side drive roller and is driven to rotate, a nipping pressure between the upstream side drive roller and the upstream side driven roller may be set to be higher than a nipping pressure between the downstream side drive roller and the downstream side driven roller, an upstream roller diameter correction table which is used in correction of an error in a medium transport speed which originates from an error in a theoretical value of a roller diameter of the upstream side drive roller, and a downstream roller diameter correction table which is used in correction of an error in a medium transport speed which originates from an error in a theoretical value of a roller diameter of the downstream side drive roller, which are referred to by the control unit, may be provided, when a single sheet of the medium is in the first transport state, the control unit may use the upstream roller diameter correction table to control the first drive source, when the single sheet of the medium is in the second transport state, the control unit may use the upstream roller diameter correction table to control the first drive source, and when the single sheet of the medium is in the third transport state, the control unit may use the downstream roller diameter correction table to control the second drive source.

When the nipping pressure between the upstream side drive roller and the upstream side driven roller is set to be higher than the nipping pressure between the downstream side drive roller and the downstream side driven roller, "kicking" which occurs when the rear end of the medium is released from the nipping between the upstream side drive roller and the upstream side driven roller occurs easily.

According to this aspect, it is possible to effectively suppress the kicking and to suppress the banding which originates from the kicking.

According to whether the medium is transported by only the upstream transport mechanism (the first transport state), whether the medium is transported by both the upstream transport mechanism and the downstream transport mechanism (the second transport state), and whether the medium is transported by only the downstream transport mechanism (the third transport state), the control unit uses the upstream roller diameter correction table which is used in correction of an error in a medium transport speed which originates from an error in a theoretical value of a roller diameter of the upstream side drive roller or the downstream roller diameter correction table which is used in correction of an error in a medium transport speed which originates from an error in a theoretical value of a roller diameter of the downstream side drive roller to control the drive sources, and thus, high precision transporting becomes possible.

At this time, in a case in which the nipping pressure between the upstream side drive roller and the upstream side driven roller is set to be still higher than the nipping pressure between the downstream side drive roller and the downstream side driven roller, when the medium is transported by both the upstream transport mechanism and the downstream transport mechanism, the transport error of the paper P tends to be dominated by the transport error of the upstream transport mechanism. Therefore, when the medium is transported by both the upstream transport mechanism and the downstream transport mechanism (the second transport state), it is possible to efficiently increase the transport precision by using the upstream roller diameter correction table to control the first drive source.

In the medium transport device, the processing unit may be a recording head which discharges a liquid to perform recording on the medium, an upstream eccentricity correction table which is used in correction of an error in the medium transport speed which originates from eccentricity in a rotating shaft of the upstream side drive roller, and a downstream eccentricity correction table which is used in correction of an error in the medium transport speed which originates from eccentricity of a rotating shaft of the downstream side drive roller, which are referred to by the control unit, may be provided, when a single sheet of the medium is in the first transport state, the control unit which controls discharging the liquid from the recording head may use the upstream eccentricity correction table to control a discharge timing of the liquid, wherein when the single sheet of the medium is in the second transport state, the control unit may use the upstream eccentricity correction table to control the discharge timing of the liquid, and when the single sheet of the medium is in the third transport state, the control unit may use the downstream eccentricity correction table to control the discharge timing of the liquid.

According to this aspect, according to whether the medium is transported by only the upstream transport mechanism (the first transport state), whether the medium is transported by both the upstream transport mechanism and the downstream transport mechanism (the second transport state), and whether the medium is transported by only the downstream transport mechanism (the third transport state), the control unit uses one of the upstream eccentricity correction table and the downstream eccentricity correction table to control the discharge timing of the liquid from the recording head, and thus, it is possible to effectively suppress the banding on the recording surface of the medium.

In the medium transport device, in a case in which recording is performed on both a leading medium which is transported by the downstream transport mechanism and a following medium which is transported by the upstream transport mechanism which are positioned in a recording region of the recording head, the control unit may use the upstream roller diameter correction table to control the first drive source and may use the downstream roller diameter correction table to control the second drive source, and the control unit may use the upstream eccentricity correction table to control the discharge timing of the liquid onto the following medium and may use the downstream eccentricity correction table to control the discharge timing of the liquid onto the leading medium.

According to this aspect, in a case in which recording is performed on both the leading medium which is transported by the downstream transport mechanism and the following medium which is transported by the upstream transport mechanism which are positioned in the recording region of the recording head, it is possible to realize high precision transporting and suppression of the banding on the recording surface with respect to both the leading medium and the following medium.

In the medium transport device, the upstream transport mechanism and the downstream transport mechanism may be transport roller pairs which nip and transport the medium or may form a transport belt mechanism in which the medium is placed on a belt and transported.

According to this aspect, in the medium transport device which is provided with transport roller pairs which nip and transport the medium or a transport belt mechanism in which the medium is placed on a belt and transported as the upstream transport mechanism and the downstream transport mechanism.

In the medium transport device, the processing unit may be a line recording head which discharges a liquid to perform recording on the medium.

According to this aspect, in the medium transport device which is provided with a recording head which discharges a liquid to perform recording on the medium as the processing unit, it is possible to obtain at least one of the same operations and effects as in the aspect which is described above.

In the medium transport device, the processing unit may be a reading unit which reads an image of the medium.

According to this aspect, in the medium transport device which is provided with a reading unit which an image of the medium as the processing unit, it is possible to obtain at least one of the same operations and effects as in the aspect which is described above.

According to another aspect of the invention, a recording apparatus includes a recording head which discharges a liquid onto a medium which is transported to perform recording, a transport roller pair which is provided on a medium transport direction upstream side of the recording head and includes an upstream side drive roller which is driven by a first drive source and an upstream side driven roller which contacts the upstream side drive roller and is driven to rotate, an output roller pair which is provided on a medium transport direction downstream side of the recording head and includes a downstream side drive roller which is driven by a second drive source and a downstream side driven roller which contacts the downstream side drive roller and is driven to rotate, a medium detector which detects a position of an end portion of the medium in the medium transport direction, a control unit which controls discharging the liquid from the recording head, and an upstream correction table which is used in correction of a medium transport speed at the transport roller pair, and a downstream correction table which is used in correction of a medium transport speed at the output roller pair, which are referred to by the control unit, in which correction values which configure the upstream correction table include a value for correcting an error in the medium transport speed which originates from eccentricity of a rotating shaft of the upstream side drive roller and correction values which configure the downstream correction table include a value for correcting an error in the medium transport speed which originates from eccentricity of a rotating shaft of the downstream side drive roller, in which, based on detection results of the medium detector, the control unit determines a transport state from among a first transport state in which a single sheet of the medium is transported by the transport roller pair and is not transported by the output roller pair, a second transport state in which the single sheet of the medium is transported by both the transport roller pair and the output roller pair, and a third transport state in which the single sheet of the medium is transported by the output roller pair and is not transported by the transport roller pair, and in which when the single sheet of the medium is in the first transport state, the control unit uses the upstream correction table to control a discharge timing of the liquid, in which when the single sheet of the medium is in the second transport state, the control unit uses either the upstream correction table or the downstream correction table to control the discharge timing of the liquid, and in which when the single sheet of the medium is in the third transport state, the control unit uses the downstream correction table to control the discharge timing of the liquid.

According to this aspect, according to whether the medium is transported by only the transport roller pair (the first transport state), whether the medium is transported by both the transport roller pair and the output roller pair (the second transport state), and whether the medium is transported by only the output roller pair (the third transport state), by using one of the upstream eccentricity correction table and the downstream eccentricity correction table to control the discharge timing of the liquid, it is possible to suppress disturbances in the recorded image such as the banding which occurs due to variation in the medium transport speed at the transport roller pair or the output roller pair.

The recording apparatus may further include an upstream roller diameter correction table which is used in correction of an error in a medium transport speed which originates from an error in a theoretical value of a roller diameter of the upstream side drive roller, and a downstream roller diameter correction table which is used in correction of an error in the medium transport speed which originates from an error in a theoretical value of a roller diameter of the downstream side drive roller, in which when a single sheet of the medium is in the first transport state, the control unit which controls transporting of the medium performed by the transport roller pair and the output roller pair may use the upstream roller diameter correction table to control the first drive source, in which when the single sheet of the medium is in the second transport state, the control unit may perform either control of the first drive source using the upstream roller diameter correction table or control of the second drive source using the downstream roller diameter correction table, and in which when the single sheet of the medium is in the third transport state, the control unit may use the downstream roller diameter correction table to control the second drive source.

According to this aspect, the upstream roller diameter correction table and the downstream roller diameter correction table are further provided, and in addition to the control of the discharge timing of the liquid from the recording head, the control unit refers to the upstream roller diameter correction table or the downstream roller diameter correction table and controls the first drive source and the second drive source, and thus, the control which suppresses disturbances in the recorded image such as the banding which occurs due to variation in the medium transport speed at the transport roller pair or the output roller pair becomes easy.

In the recording apparatus, a nipping pressure between the upstream side drive roller and the upstream side driven roller may be set to be higher than a nipping pressure between the downstream side drive roller and the downstream side driven roller, and when the medium is in the second transport state, the control unit may perform either control of the discharge timing of the liquid using the upstream correction table or control of the first drive source using the upstream roller diameter correction table.

In a case in which the nipping pressure between the upstream side drive roller and the upstream side driven roller is set to be still higher than the nipping pressure between the downstream side drive roller and the downstream side driven roller, when the medium is transported by both the transport roller pair and the output roller pair (the second transport state), the behavior of the output roller pair tends to be dominated by the behavior of the transport roller pair. Therefore, when the medium is in the second transport state, by performing either the control of the discharge timing of the liquid using the upstream correction table or the control of the first drive source using the upstream roller diameter correction table, it is possible to effectively suppress disturbances in the recorded image such as the banding.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Example

First, a description will be given of an outline of a recording apparatus according to the first example of the invention. An ink jet printer 1 (hereinafter there are cases in which this is referred to simply as the printer 1) is an example of the recording apparatus of the present example.

Figure 1:
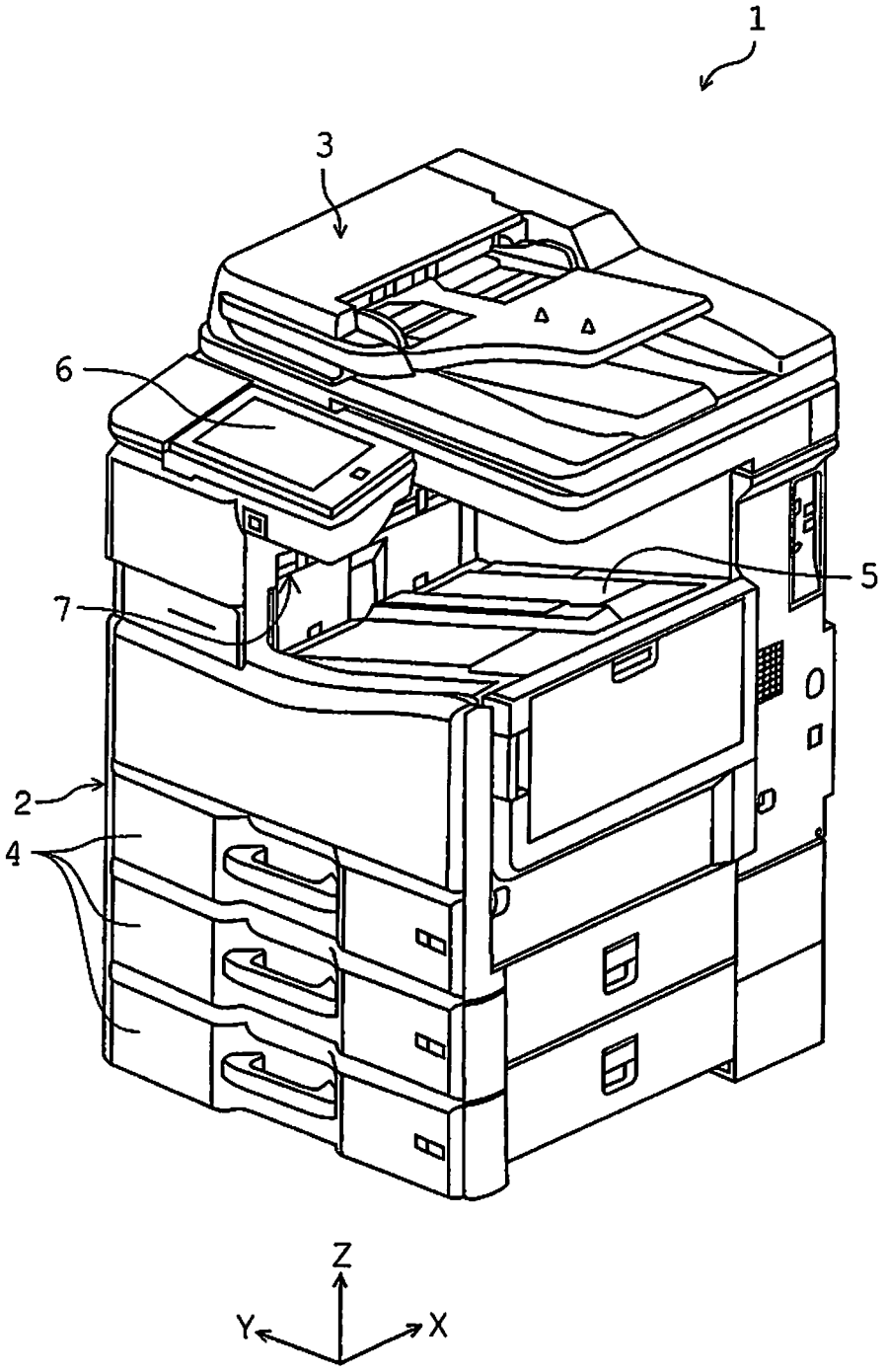
FIG. 1 is an external perspective view of a printer according to a first example of the invention.
Figure 2:
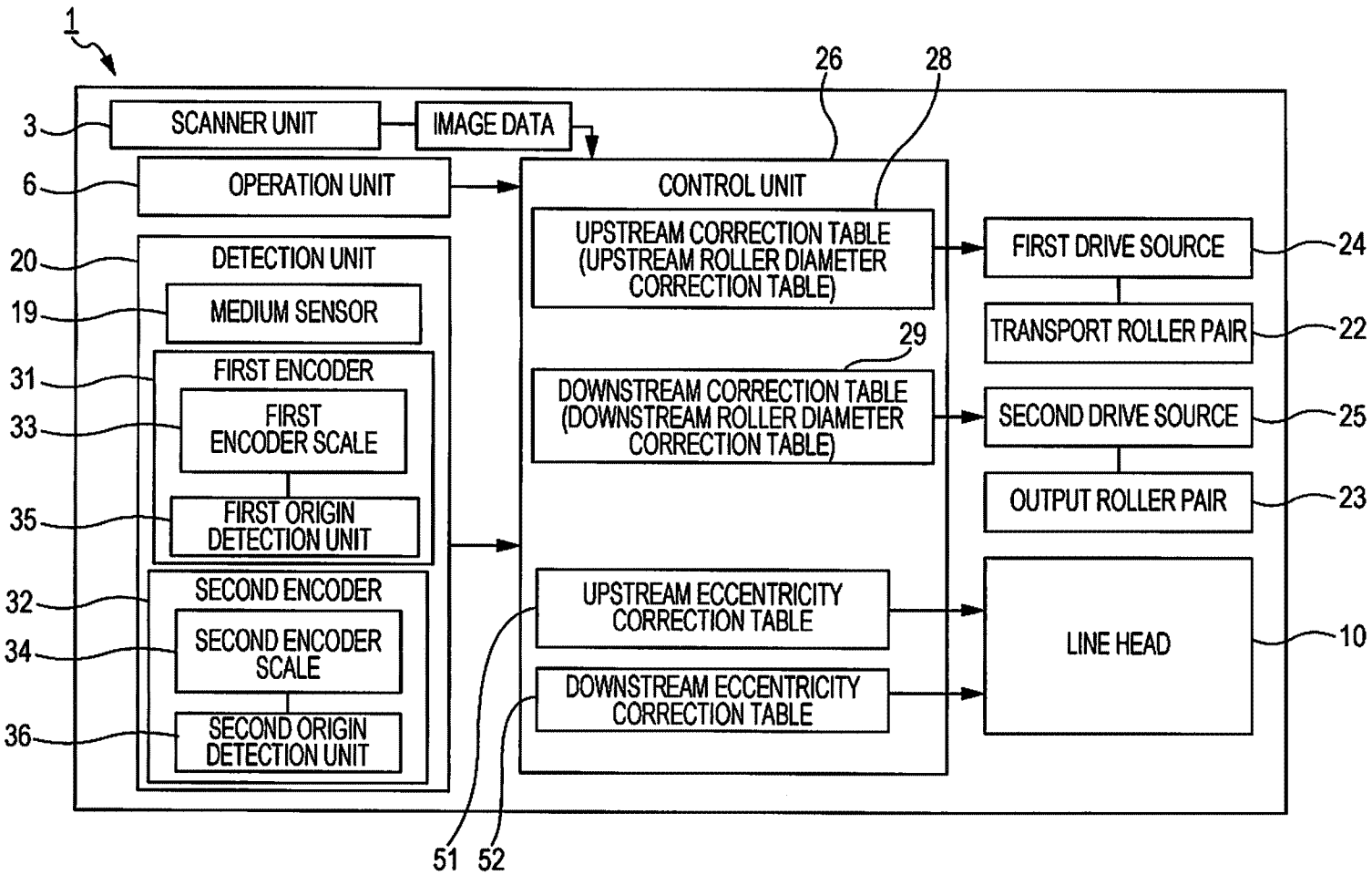
FIG. 2 is a block diagram illustrating the overall configuration of the printer.
Figure 3:
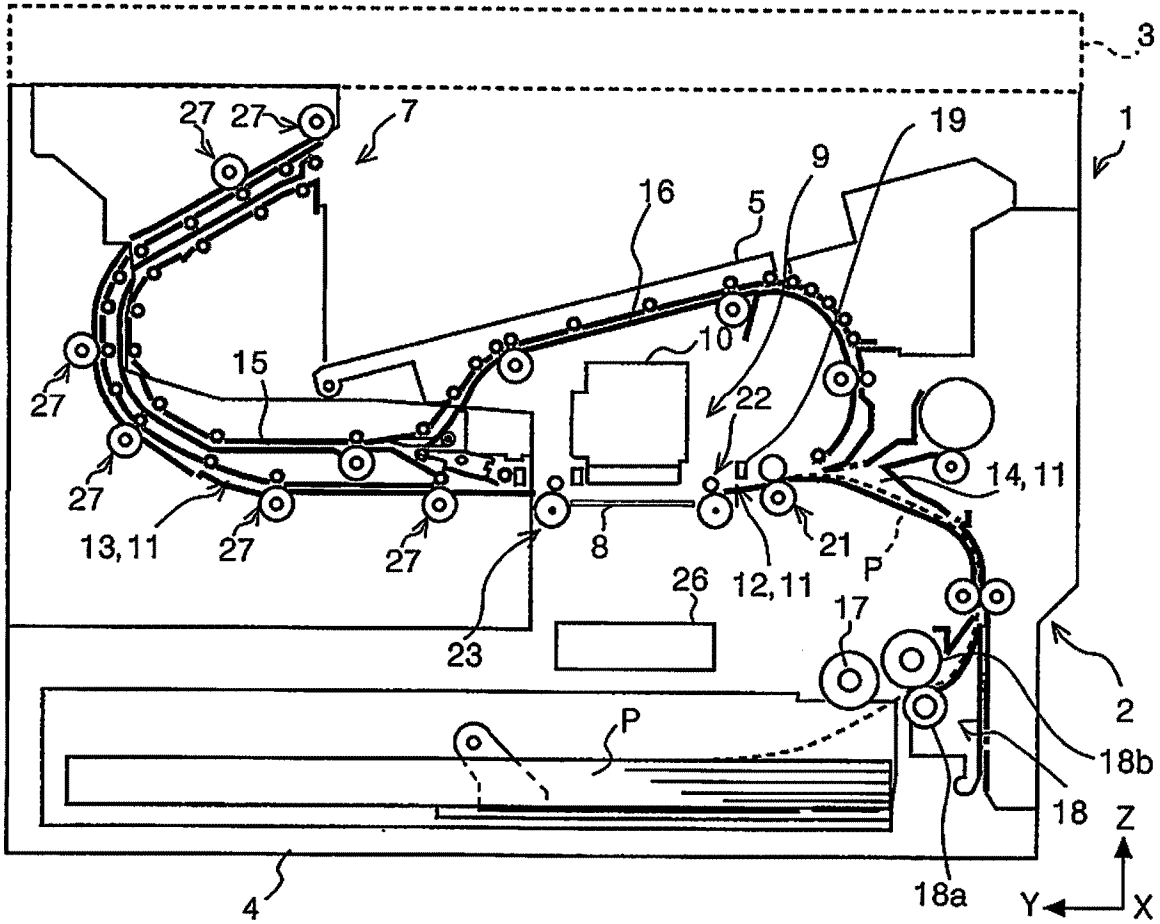
FIG. 3 is a schematic diagram illustrating a transport path of paper in the printer.
Figure 4:
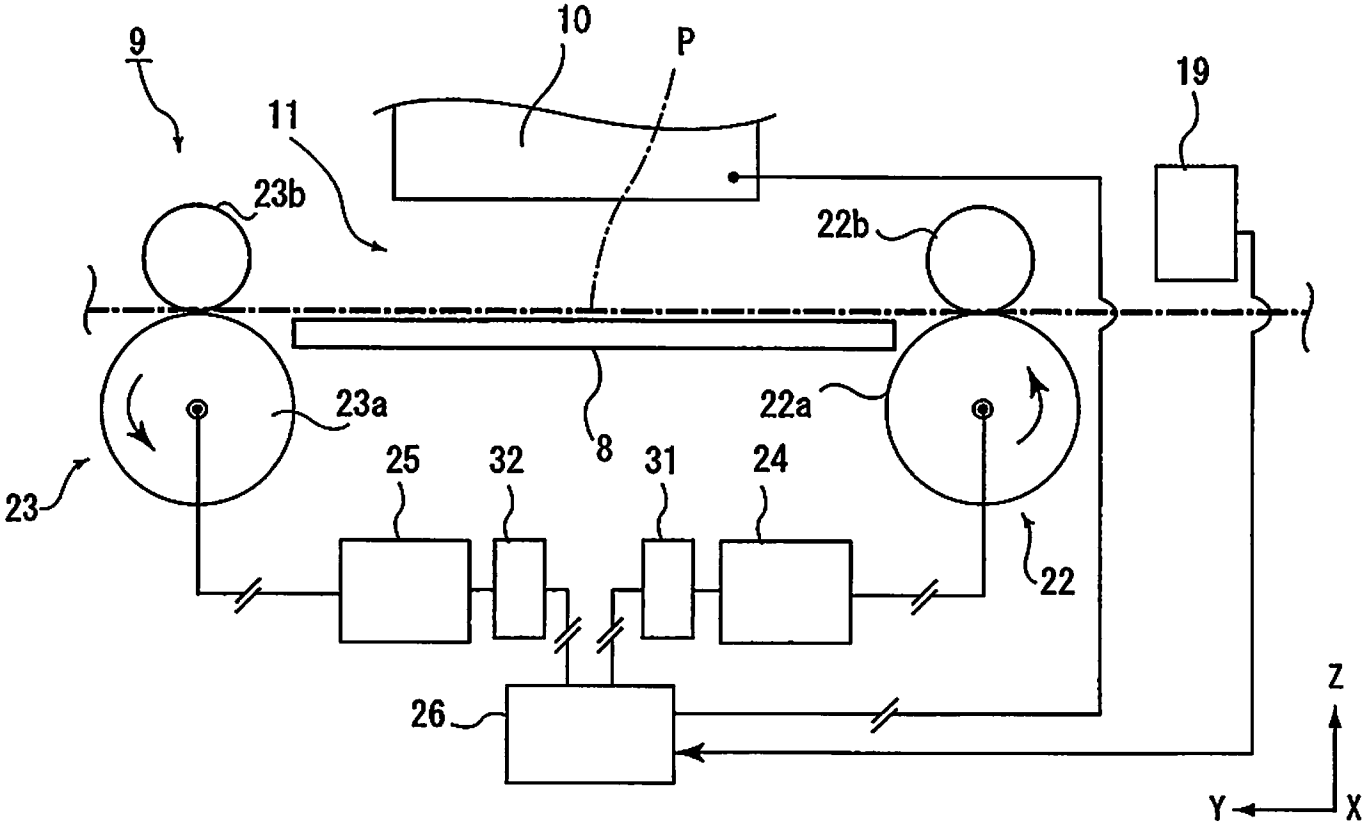
FIG. 4 is a schematic configuration diagram of a medium transport device.
Figure 5A:
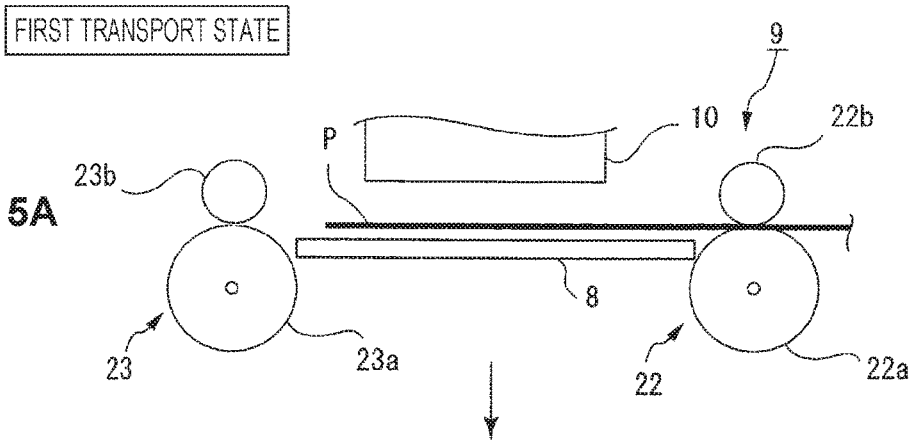
FIGS. 5A to 5C are diagrams illustrating transport states of the paper in the medium transport device.
Figure 5B:
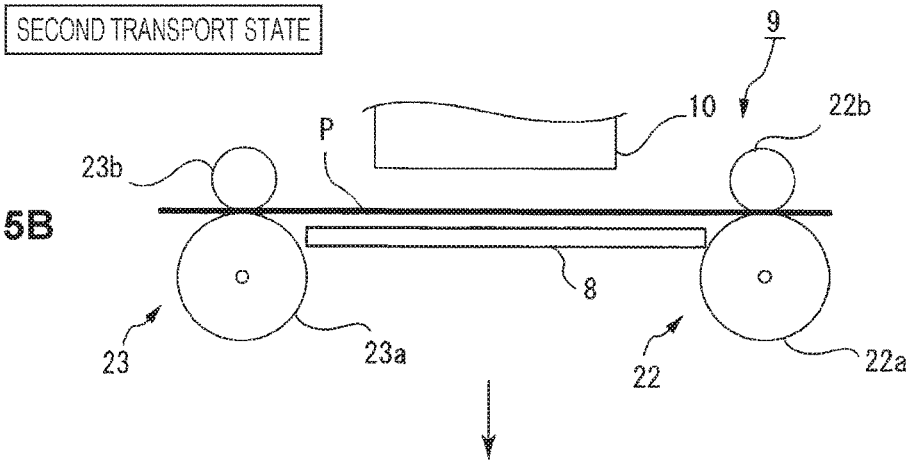
Figure 5C:
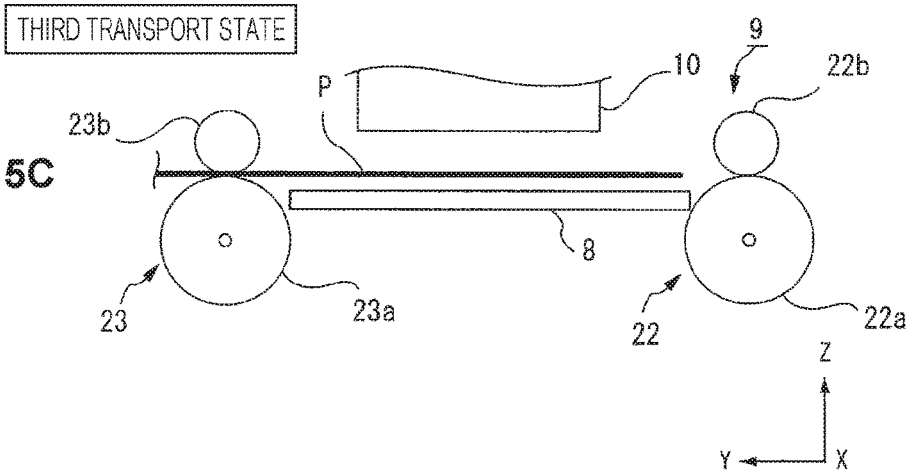
Figure 6:
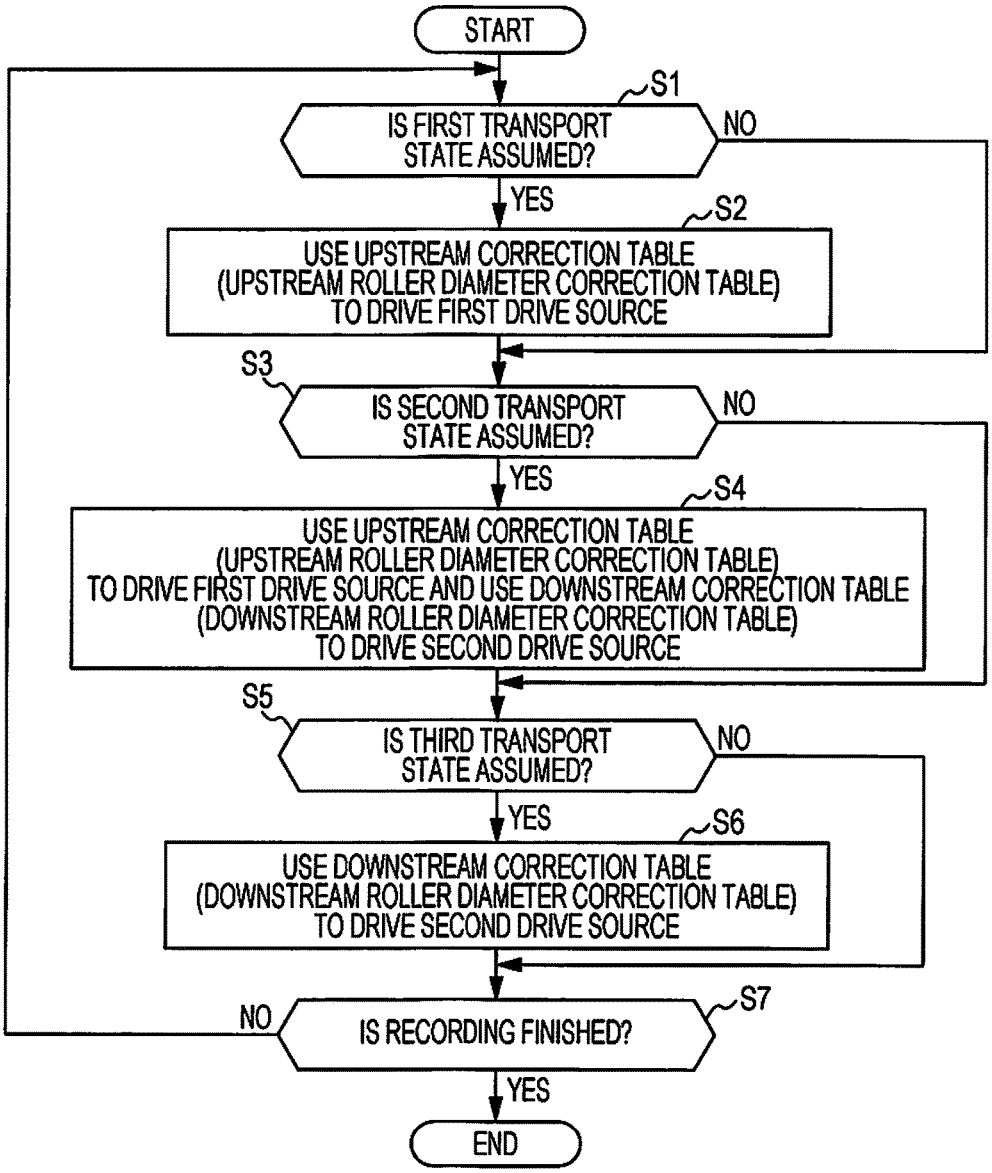
FIG. 6 is a flowchart illustrating an example of control by a control unit.
Figure 7:
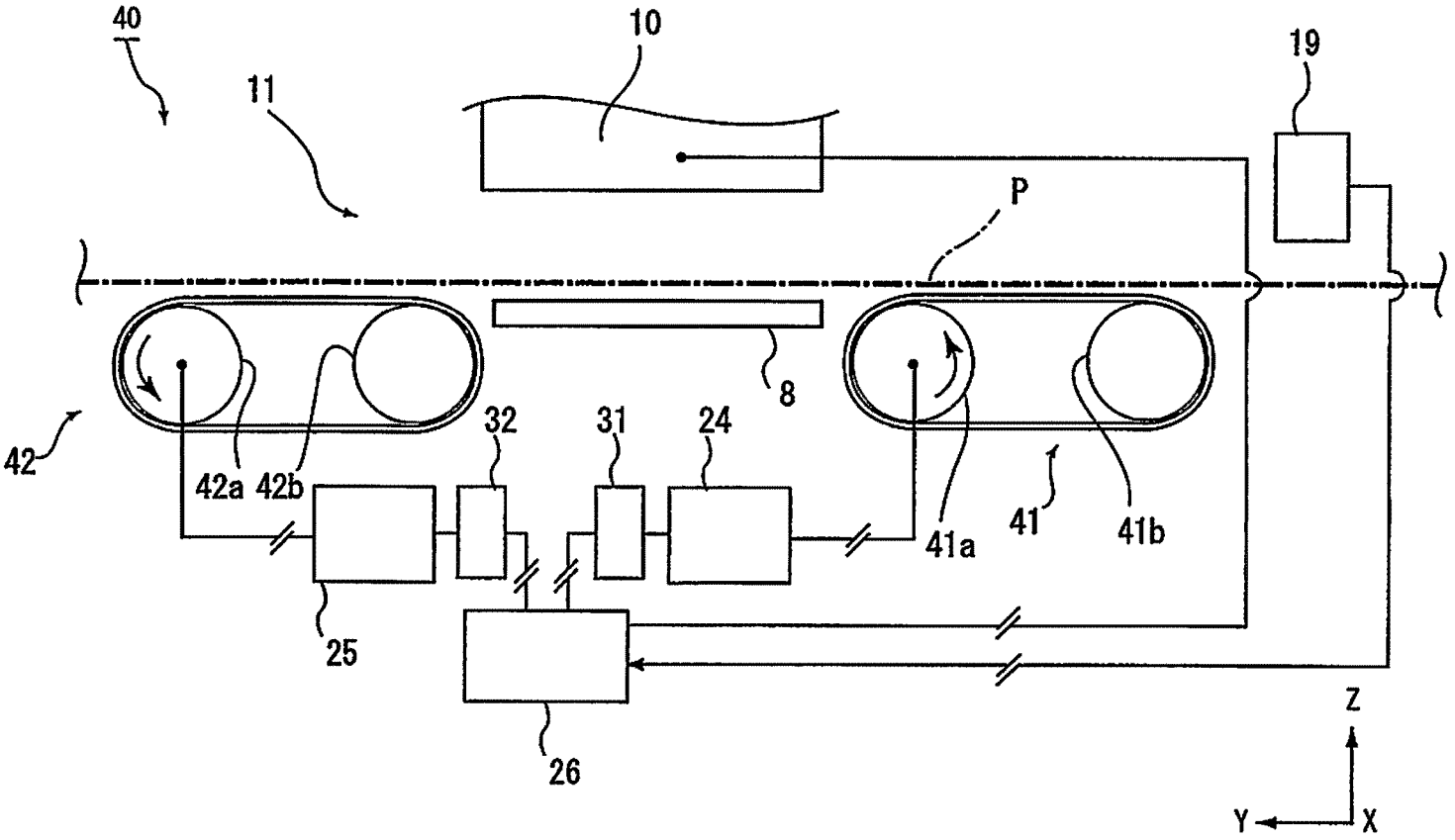
FIG. 7 is a schematic diagram illustrating a modification example of the medium transport device.
Figure 8:
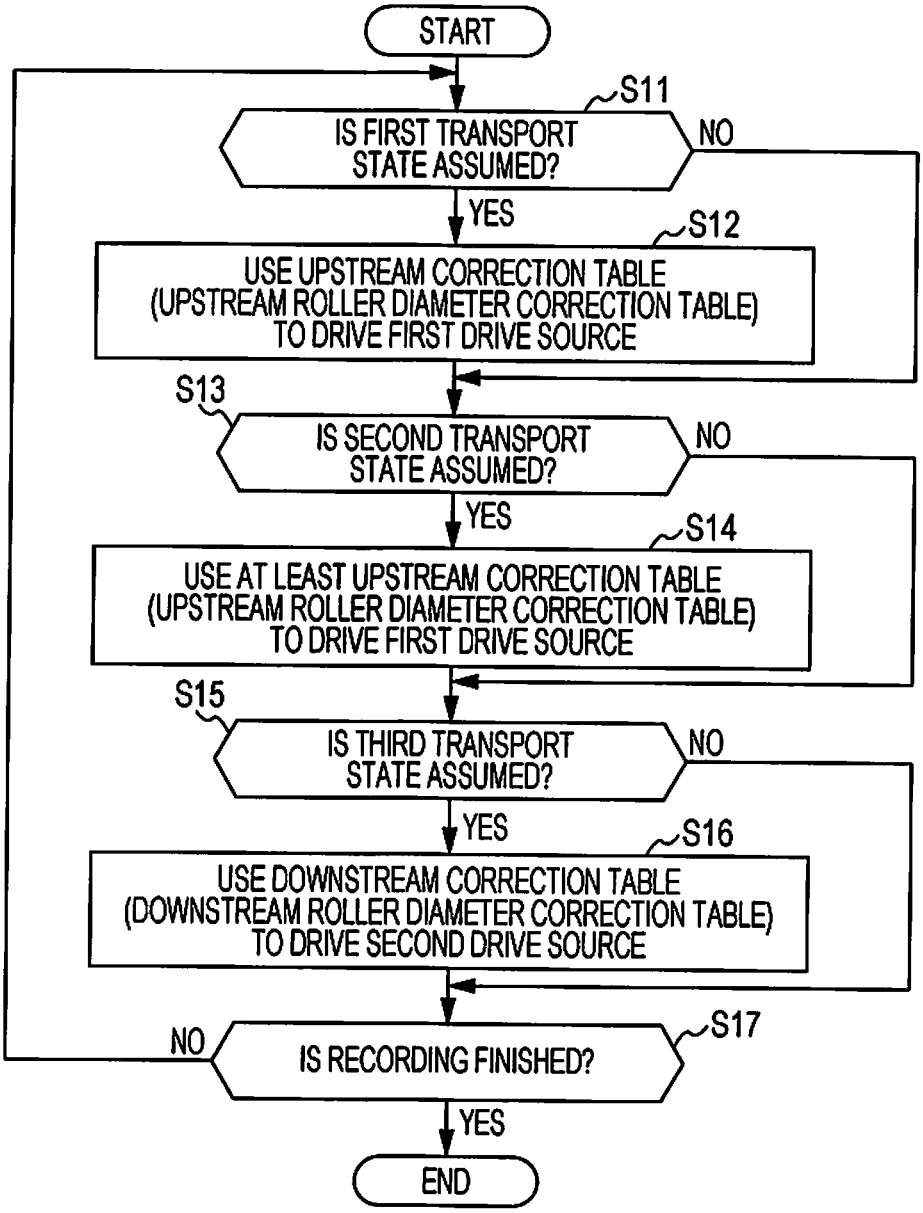
FIG. 8 is a flowchart illustrating another example of control by a control unit.
Figure 9:
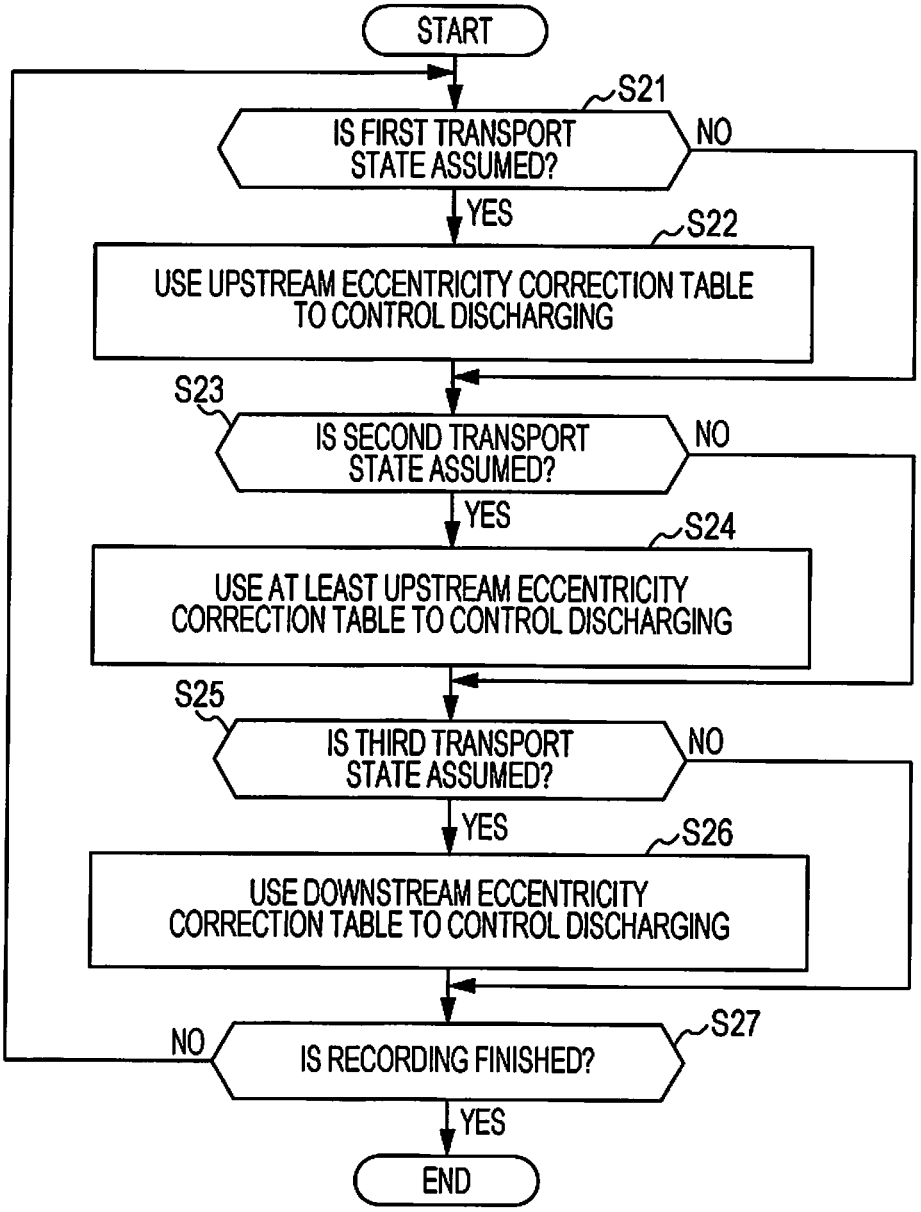
FIG. 9 is a flowchart illustrating still another example of control by a control unit.
Figure 10:
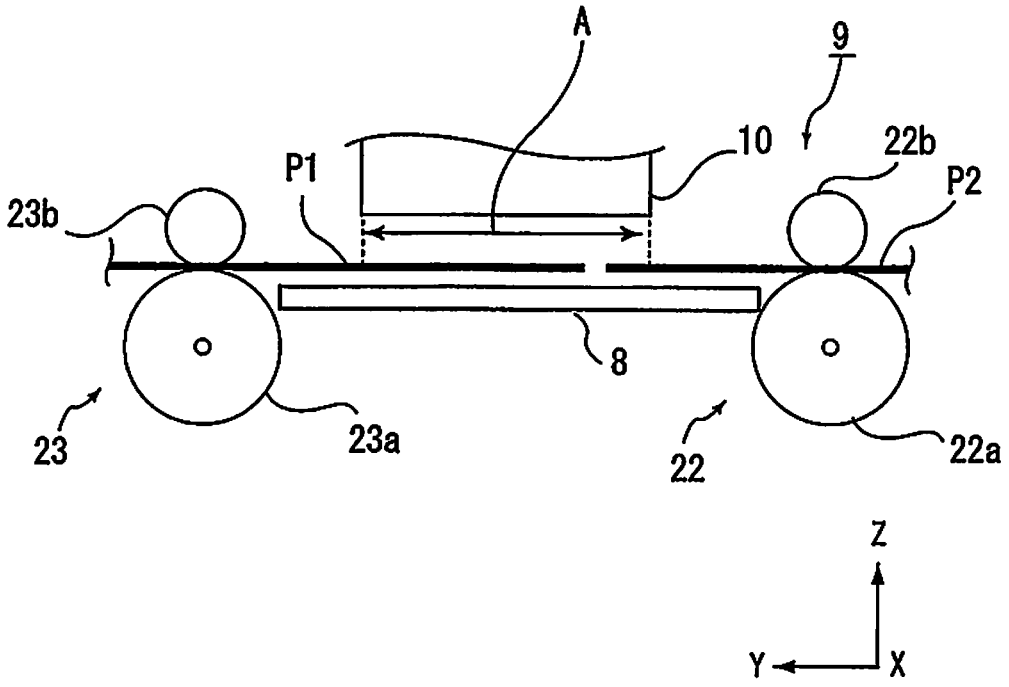
FIG. 10 is a diagram illustrating a state in which a following medium is transported following a leading medium in the medium transport device.

FIG. 1 is an external perspective view of a printer according to the first example of the invention. FIG. 2 is a block diagram illustrating the overall configuration of the printer. FIG. 3 is a schematic diagram illustrating a transport path of paper in the printer. FIG. 4 is a schematic configuration diagram of a medium transport device. FIGS. 5A to 5C are diagrams illustrating transport states of the paper in the medium transport device. FIG. 6 is a flowchart illustrating an example of control by a control unit. FIG. 7 is a schematic diagram illustrating a modification example of the medium transport device. FIG. 8 is a flowchart illustrating another example of control by a control unit. FIG. 9 is a flowchart illustrating still another example of control by a control unit. FIG. 10 is a diagram illustrating a state in which a following medium is transported following a leading medium in the medium transport device.

In the X-Y-Z coordinate system illustrated in the drawings, an X direction illustrates a width direction of a recording medium in the transport path inside the recording apparatus, a Y direction illustrates a transport direction of the recording medium, and a Z direction illustrates an apparatus height direction. In the drawings, a −X direction side is the apparatus front surface side, and a +X direction side is the apparatus rear surface side.

Outline of Printer

A description will be given of the printer 1 with reference to FIGS. 1 to 4.

The printer 1 (refer to FIG. 1) is configured as a multifunctional device including an apparatus main body 2 and a scanner unit 3. The apparatus main body 2 is provided with a plurality of paper storage cassettes 4 which store paper P (refer to FIG. 3) as the "medium". Each of the paper storage cassettes 4 is attached to be attachable and detachable from the front surface side (the −X direction side in FIG. 1) The paper P in the present specification indicates paper such as ordinary paper, cardboard, or photographic paper, for example.

An output portion 7 and a medium placement portion 5 are provided between the scanner unit 3 and the paper storage cassettes 4 in the apparatus height direction (the Z direction) in the apparatus main body 2. The paper P on which the recording is executed at a line head 10 (FIG. 3, described later) is output at the output portion 7 and the paper P which is output from the output portion 7 is placed on the medium placement portion 5. An operation unit 6 is provided on the front surface side of the apparatus main body 2. A displayer such as a liquid crystal panel is provided on the operation unit 6. It is possible to input instructions of the recording operation and the image reading operation to the printer 1 by operating the operation unit 6.

Next, with reference to FIGS. 2 and 3, the printer 1 is a "processing unit" which performs a process relating to the paper P which is transported and is provided with the line head 10 which is the "recording head" and a medium transport device 9 which transports the paper P to a recording region of the line head 10.

The line head 10 discharges an ink (a liquid) onto the paper P which is transported to perform recording on the paper P.

The medium transport device 9 (FIG. 4) is configured to include a transport roller pair 22, an output roller pair 23, a first drive source 24, a second drive source 25, a medium sensor 19, and a control unit 26. The transport roller pair 22 is an example of the "upstream transport mechanism" which is provided on the medium transport direction upstream side (hereinafter referred simply to as the upstream side) of the line head 10, the output roller pair 23 is an example of the "downstream transport mechanism" which is provided on the medium transport direction downstream side (hereinafter referred to simply as the downstream side) of the line head 10, the first drive source 24 drives the transport roller pair 22, the second drive source 25 drives the output roller pair 23, the medium sensor 19 is an example of the "medium detector" which detects the position of the end portion of the paper P in the medium transport direction of a detection unit 20 (FIG. 2), and the control unit 26 controls the transporting of the paper P performed by the transport roller pair 22 and the output roller pair 23.

As illustrated in FIG. 4, the transport roller pair 22 is configured to include an upstream side drive roller 22*a* which is driven by the first drive source 24 and an upstream side driven roller 22*b* which contacts the upstream side drive roller 22*a* and is driven to rotate.

The output roller pair 23 is configured to include a downstream side drive roller 23*a* which is driven by the second drive source 25 and a downstream side driven roller 23*b* which contacts the downstream side drive roller 23*a* and is driven to rotate.

The control unit 26 receives image data which is read by the scanner unit 3, is configured to be capable of executing the necessary control for the recording operation in the printer 1, and controls the operations of, in addition to the transport roller pair 22 and the output roller pair 23, other constituent members in the printer 1 such as the discharge operation of the ink from the line head 10.

In the printer 1, it is also possible to adopt a configuration in which the control unit 26 receives the image data which is transmitted from an external PC (personal computer) (not illustrated) which is connected to the printer 1, for example, and executes the recording. A detailed description of the configuration of the medium transport device 9 will be further given later.

Regarding Transport Path of Printer

Next, a description will be given of the transport path of the paper P in the printer 1 using FIG. 3.

In the printer 1 in the present example, a transport path 11 of the paper P includes a feed path 14, a straight path 12, and a face-down output path 13. The feed path 14 feeds the paper which is picked up from the paper storage cassettes 4, the straight path 12 is connected to the feed path 14 and includes a recording region of the line head 10, and the face-down output path 13 feeds the paper from the straight path 12 to the output portion 7.

Hereinafter, a description will be given of the transporting of the paper P from the paper storage cassettes 4 to the output portion 7.

The printer 1 is includes a switchback path 15 which splits off from the straight path 12 on the downstream side of the line head 10 and an inverting path 16 which is connected to the switchback path 15 and inverts the obverse and reverse (a first surface and a second surface) of the paper P to return the paper P to the straight path 12, and is configured to be capable of so-called duplex recording in which recording of the second surface is executed after recording of the first surface of the paper P. The description of the inversion of the paper P by the switchback path 15 and the inverting path 16 will be omitted.

A feed roller 17 and a separation roller pair 18 which separates a plurality of sheets of paper into single sheets are provided in the feed path 14 in order along the transport direction of the paper P.

The feed roller 17 is configured to rotationally drive according to a drive source (not illustrated). The separation roller pair 18 is also referred to as a retarding roller and is configured to include a drive roller 18*a* and a driven roller 18*b*. The drive roller 18*a* is an example of a "feeding unit" which feeds the medium toward the transport roller pair 22 (described later) and the driven roller 18*b* is an example of a "separating unit" which nips and separates the paper P between the drive roller 18*a* and the driven roller 18*b*.

As illustrated in FIG. 3, in the plurality of sheets of the paper P which is stored in the paper storage cassettes 4, a topmost sheet of the paper P is picked up by the feed roller 17 and is transported to the downstream side in the transport direction. At this time, there is a case in which the next sheet or more of the paper P is also transported together with the topmost sheet of the paper P; however, the topmost sheet of the paper P is separated from the next sheet or more of the paper P by the separation roller pair 18 and only the topmost sheet of the paper P is fed to the feed path 14.

A resist roller 21 is provided on the downstream side in the transport direction of the separation roller pair 18. In the present example, the feed path 14 and the straight path 12 are connected at the position of the resist roller 21.

The straight path 12 is configured as a path which extends in a straight line shape and is provided with, in order along the transport direction, the resist roller 21, the medium sensor 19, the transport roller pair 22, the line head 10, and the output roller pair 23. The straight path 12 is a path which passes the line head 10 and extends to the upstream side and the downstream side of the line head 10.

A medium support unit 8 is disposed in a region facing the head surface of the line head 10 in FIG. 3. The medium support unit 8 supports the paper P from the opposite side of the recording surface.

In the present example, the line head 10 is configured to discharge an ink onto the recording surface of the paper P to execute the recording when the paper P is transported to the region facing the line head 10 of the medium support unit 8.

The line head 10 is a recording head in which nozzles which discharge the ink are provided to cover the entire width of the paper P and is configured as a recording head which is capable of recording on the entire width of the medium without an accompanying movement in the medium width direction.

The paper P which is transported in the straight path 12 is next fed to the face-down output path 13. The face-down output path 13 is the transport path 11 which is connected to the straight path 12 and is a path which feeds the paper P which is recorded by the line head 10 with the recording surface of the paper P facing downward such that the paper P is output from the output portion 7.

The paper P which enters the face-down output path 13 is transported by a plurality of transport roller pairs 27, is output from the output portion 7 and is placed on the medium placement portion 5 with the recording surface facing downward.

Regarding Medium Transport Device

Next, a description will be given of the medium transport device 9 with reference to FIGS. 2 to 10.

The medium transport device 9 has features in the transport roller pair 22 and the output roller pair 23 which include individual drive sources (the first drive source 24 and the second drive source 25) and the control unit 26 which controls the driving of the transport roller pair 22 and the output roller pair 23.

In a case in which the transport roller pair 22 and the output roller pair 23 are driven by one drive source via a motive force transmission mechanism such as a gear train, an increase in which medium transport speed (kicking) which occurs when the rear end of the paper P leaves the transport roller pair 22 is transmitted to the output roller pair 23 and there is a concern that banding (white line-shaped recording inconsistencies) will occur in the recorded image of the paper P.

Due to the transport roller pair 22 and the output roller pair 23 being individually driven by the first drive source 24 and the second drive source 25, respectively, it is possible to reduce the concern of the "kicking" being transmitted to the output roller pair 23, and as such, it is possible to suppress the occurrence of the banding.

A first encoder 31 and a second encoder 32 (FIGS. 2 and 4) which are of a rotary system are provided on the upstream side drive roller 22*a* of the transport roller pair 22 and the downstream side drive roller 23*a* of the output roller pair 23, respectively. A disc-shaped first encoder scale 33 (not illustrated in FIGS. 2 and 4) in which multiple radial slits are carved is provided on the same axis as the rotating shaft (not illustrated) of the upstream side drive roller 22*a*. Similarly, a second encoder scale 34 (not illustrated in FIGS. 2 and 4) is also provided on the same axis as the rotating shaft (not illustrated) of the downstream side drive roller 23*a*. The first encoder 31 and the second encoder 32 are configured to be capable of outputting pulse-form encoder signals (pulse signals) to ascertain the rotation amount of the upstream side drive roller 22*a* (the transport roller pair 22) and the downstream side drive roller 23*a* (the output roller pair 23), respectively, by reading the first encoder scale 33 and the second encoder scale 34 corresponding to the first encoder 31 and the second encoder 32, respectively.

Origin positions are set in the first encoder scale 33 which configures the first encoder 31 and the second encoder scale 34 which configures the second encoder 32, respectively, and the first encoder 31 detects the origin position of the first encoder scale 33 before the transporting of the paper P performed by the transport roller pair 22 (the upstream transport mechanism), and the second encoder 32 detects the origin position of the second encoder scale 34 before the transporting of the paper P performed by the output roller pair 23 (the downstream transport mechanism).

Specifically, the first encoder 31 is provided with a first origin detection unit 35 (FIG. 2) which detects the origin position of the first encoder scale 33 and the second encoder 32 is provided with a second origin detection unit 36 (FIG. 2) which detects the origin position of the second encoder scale 34.

The first encoder 31 is configured such that when the first encoder 31 detects the origin position of the first encoder scale 33 using the first origin detection unit 35, the first encoder 31 outputs a signal (an origin signal) indicating the origin position of the upstream side drive roller 22*a*. In the same manner, the second encoder 32 is configured such that when the second encoder 32 detects the origin position of the second encoder scale 34 using the second origin detection unit 36, the second encoder 32 outputs a signal (an origin signal) indicating the origin position of the downstream side drive roller 23*a*.

A configuration is adopted in which the pulse signals (the signals indicating the rotation amount of the drive rollers) which are output from the first encoder 31 and the second encoder 32 and the origin signals (the signals indicating the origin positions of the drive rollers) are sent to the control unit 26 and the rotation amount and the rotation speed which use the origin positions of the drive rollers (the upstream side drive roller 22*a* and the downstream side drive roller 23*a*) as reference points are obtained.

Here, the control unit 26 determines a transport state from among a first transport state (FIG. 5A), a second transport state (FIG. 5B), and a third transport state (FIG. 5C) based on the detection results of the detection unit 20. In the first transport state, a single sheet of the paper P is transported by the transport roller pair 22 and is not transported by the output roller pair 23, in the second transport state, the single sheet of the paper P is transported by both the transport roller pair 22 and the output roller pair 23, and in the third transport state, the single sheet of the paper P is transported by the output roller pair 23 and is not transported by the transport roller pair 22.

For example, it is possible to determine the transport state according to the driving amount of the transport roller pair 22 and the driving amount of the output roller pair 23 after the leading end of the medium is detected by the medium sensor 19 using the medium sensor 19, the first encoder 31, and the second encoder 32.

For example, it is also possible to determine the transport state according to the driving amount of the feed roller 17 after the paper P is picked up by the feed roller 17. In this case, an encoder which detects the driving amount of the feed roller 17 is provided separately.

The control unit 26 is configured to control the first drive source 24 and the second drive source 25 based on the determination result of the transport state (any of the first transport state to the third transport state).

Accordingly, high precision transportation of the paper P by the medium transport device 9 becomes possible. Hereinafter, a description is given with more specific examples.

Control of Transport Roller Pair and Output Roller Pair by Control Unit

Referring to FIG. 2, the printer 1 is provided with an upstream correction table 28 and a downstream correction table 29 which are referred to by the control unit 26. The upstream correction table 28 is a correction table which is used in the correction of the medium transport speed at the transport roller pair 22. The downstream correction table 29 is a correction table which is used in the correction of the medium transport speed at the output roller pair 23.

There is a case in which there is an error within a permissible error range at the roller diameters of each of the upstream side drive roller 22*a* and the downstream side drive roller 23*a*.

In the present embodiment, the upstream correction table 28 is an "upstream roller diameter correction table" which is used in the correction of the error in the medium transport speed which originates from the error in the roller diameter of the upstream side drive roller 22*a* and is table data indicating the correspondence relationship between a count of the pulse signal from the first encoder 31 and a correction value for correcting the error in the roller diameter of the upstream side drive roller 22*a*.

The downstream correction table 29 is a "downstream roller diameter correction table" which is used in the correction of the error in the medium transport speed which originates from the error in the roller diameter of the downstream side drive roller 23*a* and is table data indicating the correspondence relationship between a count of the pulse signal from the second encoder 32 and a correction value for correcting the error in the roller diameter of the downstream side drive roller 23*a*.

The term "error in the roller diameter" means the error between a theoretical value and an actual value of the roller diameter.

Due to the influence of the "error in the roller diameter", even if the roller rotates at the same angular speed, the transport speed of the medium changes due to the size of the roller diameter. Specifically, if the angular speed is the same, the transport speed of the medium increases the larger the roller diameter becomes. In other words, this means that the transport speed of the medium becomes faster than the theoretical value if the roller diameter is greater than the theoretical value.

Therefore, in order to cause the transport speed of the medium to approach the theoretical value, as described above, the rotational speeds of the transport roller pair 22 and the output roller pair 23 may be controlled using the correction tables.

Referring to FIG. 6, a description will be given of the control of the transport roller pair 22 and the output roller pair 23 by the control unit 26.

The control unit 26 controls each of the first drive source 24 and the second drive source 25 according to the manner in which the single sheet of the paper P is being nipped by the transport roller pair 22 and the output roller pair 23.

In the printer 1, the reception of the image data in the control unit 26 is used as a trigger, the driving of the feed roller 17 is started and the paper P is fed, the first drive source 24 and the second drive source 25 are controlled by the control unit 26 and the transport roller pair 22, and the output roller pair 23 rotate at fixed speeds.

When the paper P is fed along the transport path 11 and the leading end of the paper P is detected by the medium sensor 19, the detection is used as a trigger and the control illustrated in the flowchart of FIG. 6 is performed. The start of the control need not be directly after the detection of the leading end of the paper P by the medium sensor 19, and it is possible to start the control based on the distance from the medium sensor 19 to the transport roller pair 22 and the driving amount of the resist roller 21. It is also possible to start the control based on the driving amount from the start of the driving of the feed roller 17 instead of the detection of the paper P by the medium sensor 19.

First, in step S1, it is determined whether or not the paper P is in the first transport state. If the paper P is in the first transport state (FIG. 5A), the process proceeds to step S2, and if the paper P is not in the first transport state, the process proceeds to step S3.

In step S2, the first drive source 24 is controlled using the upstream correction table 28 and the process subsequently proceeds to step S3.

Next, in step S3, it is determined whether or not the paper P is in the second transport state. If the paper P is in the second transport state (FIG. 5B), the process proceeds to step S4, and if the paper P is not in the second transport state, the process proceeds to step S5.

In step S4, the first drive source 24 is controlled using the upstream correction table 28, the second drive source 25 is controlled using the downstream correction table 29, and the process subsequently proceeds to step S5.

Next, in step S5, it is determined whether or not the paper P is in the third transport state. If the paper P is in the third transport state (FIG. 5C), the process proceeds to step S6, and if the paper P is not in the third transport state, the process proceeds to step S7.

In step S6, the second drive source 25 is controlled using the downstream correction table 29 and the process subsequently proceeds to step S7.

Next, in step S7, it is determined whether or not the recording is finished. If the recording is not finished, the process returns to step S1, and if the recording is finished, the control is finished.

In other words, when the single sheet of the paper P is transported by only the transport roller pair 22 (the first transport state), the control unit 26 uses the upstream correction table 28 relating to the transport roller pair 22 to control the first drive source 24, when the single sheet of the paper P is transported by both the transport roller pair 22 and the output roller pair 23 (the second transport state), the control unit 26 uses the correction tables corresponding to both the drive sources (the first drive source 24 and the second drive source 25), respectively, to perform the control, and when the single sheet of the paper P is transported by only the output roller pair 23 (the third transport state), the control unit 26 uses the downstream correction table 29 relating to the output roller pair 23 to control the second drive source 25. According to this control, high precision transportation of the paper P by the medium transport device 9 becomes possible.

In the present embodiment it is desirable for the first encoder 31 to detect the origin position of the first encoder scale 33 using the first origin detection unit 35 before the transporting of the paper P performed by the transport roller pair 22 (the upstream transport mechanism) and for the second encoder 32 to detect the origin position of the second encoder scale 34 using the second origin detection unit 36 before the transporting of the paper P performed by the output roller pair 23 (the downstream transport mechanism).

Accordingly, it is possible to perform correction which uses corresponding correction tables on the respective drive rollers (the upstream side drive roller 22*a* and the downstream side drive roller 23*a*) of the transport roller pair 22 and the output roller pair 23, using the origin positions as references. Therefore, it is possible to increase the precision of the correction which uses the correction tables.

In the present embodiment, the transport roller pair 22 and the output roller pair 23 are adopted as the "upstream transport mechanism" and the "downstream transport mechanism" which are provided on the upstream side and the downstream side to interpose the line head 10; however, as in a medium transport device 40 illustrated in FIG. 7, it is also possible to use an upstream side belt mechanism 41 and a downstream side belt mechanism 42 in which the paper P is placed on belts and transported as a modification example.

In the medium transport device 40, an upstream side drive roller 41*a* of the upstream side belt mechanism 41 is driven by the first drive source 24, a downstream side drive roller 42*a* of the downstream side belt mechanism 42 is driven by the second drive source 25, and it is possible to perform the same control as that of the medium transport device 9 with respect to the first drive source 24 and the second drive source 25 according to the transport state (the first transport state to the third transport state) of the paper P. In FIG. 7, reference numerals 41*b* and 42*b* are an upstream side driven roller 41*b* and a downstream side driven roller 42*b*, and the configuration which is the same as that of the medium transport device 9 is assigned the same reference numerals.

Case in which Nipping Pressure of Transport Roller Pair is Higher than Nipping Pressure of Output Roller Pair Incidentally, there is a case in which in the medium transport device 9, the nipping pressure of the transport roller pair 22 which is provided on the upstream side of the line head 10, that is, the nipping pressure between the upstream side drive roller 22*a* and the upstream side driven roller 22*b* is set to be higher than the nipping pressure of the output roller pair 23 which contacts the recording surface of the paper P after recording, that is, the nipping pressure between the downstream side drive roller 23*a* and the downstream side driven roller 23*b*.

When the nipping pressure of the transport roller pair 22 is higher than the nipping pressure of the output roller pair 23, in the transport error in the second transport state (FIG. 5B) in which the single sheet of the paper P is nipped by both roller pairs, the influence of the transport error based on the transport roller pair 22 becomes greater.

In any case, the control unit 26 is capable of performing the control illustrated in the flowchart of FIG. 8. Steps S11, S12, and S15 to S17 in FIG. 8 are the same as steps S1, S2, and S5 to S7 in FIG. 6 and the description thereof will be omitted.

In a case in which the nipping pressure of the transport roller pair 22 is higher than the nipping pressure of the output roller pair 23, in step S13 which determines whether or not the paper P is in the second transport state (FIG. 5B), when it is determined that the second transport state is assumed, the process proceeds to step S14 and the first drive source 24 is controlled using at least the upstream correction table 28 (the upstream roller diameter correction table).

In other words, in step S14, the control unit 26 either performs only the control of the first drive source 24 which uses the upstream correction table 28, or the control of the first drive source 24 which uses the upstream correction table 28 and the control of the second drive source 25 which uses the downstream correction table 29.

The control unit 26 is capable of increasing the transport precision of the paper P in the second transport state by controlling mainly the transport roller pair 22 (the nipping pressure is higher than the nipping pressure of the output roller pair 23 and the influence on the transport error in the second transport state (FIG. 5B) is great).

In a case in which the nipping pressure by the transport roller pair 22 is high and the transport error which is based on the transport roller pair 22 is dominant, the first drive source 24 may be controlled using only the upstream correction table 28.

When the nipping pressure of the transport roller pair 22 is set to be higher than the nipping pressure of the output roller pair 23, the "kicking" which occurs when the rear end of the paper P leaves the transport roller pair 22 occurs easily; however, by performing the control illustrated in the flowchart of FIG. 8, it is possible to effectively control the "kicking" and suppress the occurrence of the banding which originates from the kicking.

I the present embodiment, the rotation speed of the output roller pair 23 is set to be faster than the rotation speed of the transport roller pair 22 and the bending of the paper P between the transport roller pair 22 and the output roller pair 23 in the second transport state is suppressed.

Regarding Control of Discharging of Ink from Line Head by Control Unit

In the transport roller pair 22 and the output roller pair 23, for example, there is a case in which the rotating shafts of the drive rollers (the upstream side drive roller 22*a* and the downstream side drive roller 23*a*) are eccentric within a permissible error range or are attached eccentrically with respect to the bearings.

When the rotating shafts of the drive rollers are eccentric, even if the drive sources (the first drive source 24 in the transport roller pair 22 and the second drive source 25 in the output roller pair 23) are driven at fixed speeds, the medium transport speed while the drive rollers rotate is no longer fixed.

Therefore, the printer 1 is provided with an upstream eccentricity correction table 51 (FIG. 2) and a downstream eccentricity correction table 52 (FIG. 2) which are referred to by the control unit 26. The upstream eccentricity correction table 51 is used in the correction of an error in the medium transport speed which originates from the eccentricity of the rotating shaft of the upstream side drive roller 22*a* and the downstream eccentricity correction table 52 is used in the correction of an error in the medium transport speed which originates from the eccentricity of the rotating shaft of the downstream side drive roller 23*a*.

The upstream eccentricity correction table 51 is table data indicating the correlation relationship between the count of the pulse signals from the first encoder 31 and the correction value for correcting the error in the medium transport speed which originates from the eccentricity of the rotating shaft of the upstream side drive roller 22*a*.

The downstream eccentricity correction table 52 is table data indicating the correlation relationship between the count of the pulse signals from the second encoder 32 and the correction value for correcting the error in the medium transport speed which originates from the eccentricity of the rotating shaft of the downstream side drive roller 23*a*.

The control unit 26 uses the upstream eccentricity correction table 51 and the downstream eccentricity correction table 52 to control the discharging of the ink (the liquid) from the line head 10.

A description will be given of the control of the ink discharge timing from the line head 10 by the control unit 26 with reference to FIG. 9.

In the same manner as the control of the transport roller pair 22 and the output roller pair 23 by the control unit 26, for example, when the paper P is transported in the transport path 11 and the leading end of the paper P is detected by the medium sensor 19, the detection is used as a trigger and the control illustrated in the flowchart of FIG. 9 is performed.

First, in step S21, it is determined whether or not the paper P is in the first transport state. If the paper P is in the first transport state (FIG. 5A), the process proceeds to step S22, and if the paper P is not in the first transport state, the process proceeds to step S23.

In step S22, the discharge timing of the ink from the line head 10 is controlled using the upstream eccentricity correction table 51 and the process subsequently proceeds to step S23.

Next, in step S23, it is determined whether or not the paper P is in the second transport state.

If the paper P is in the second transport state (FIG. 5B), the process proceeds to step S24, and if the paper P is not in the second transport state, the process proceeds to step S25.

In step S24, the discharge timing of the ink from the line head 10 is controlled using at least the upstream eccentricity correction table 51 and the process subsequently proceeds to step S25.

In a case in which the nipping pressure of the transport roller pair 22 is set to be higher than the nipping pressure of the output roller pair 23, in step S24, it is possible to perform control of the ink discharge timing using only the upstream eccentricity correction table 51.

Both the upstream eccentricity correction table 51 and the downstream eccentricity correction table 52 may be used to control the ink discharge timing. In this case, for example, it is possible to use the average value of the correction value of the upstream eccentricity correction table 51 and the correction value of the downstream eccentricity correction table 52 (a value obtained by adding both of the correction values together and dividing the result by two).

Next, in step S25, it is determined whether or not the paper P is in the third transport state.

If the paper P is in the third transport state (FIG. 5C), the process proceeds to step S26, and if the paper P is not in the third transport state, the process proceeds to step S27.

In step S26, the ink discharge timing from the line head 10 is controlled using the downstream eccentricity correction table 52 and the process subsequently proceeds to step S27.

Next, in step S27, it is determined whether or not the recording is finished. If the recording is not finished, the process returns to step S21, and if the recording is finished, the control is finished.

In other words, when the single sheet of the paper P is transported by only the transport roller pair 22 (the first transport state), the control unit 26 uses the upstream eccentricity correction table 51 relating to the transport roller pair 22 to control the ink discharge timing, when the single sheet of the paper P is transported by both the transport roller pair 22 and the output roller pair 23 (the second transport state), the control unit 26 uses at least the upstream eccentricity correction table 51 to control the ink discharge timing, and when the single sheet of the paper P is transported by only the output roller pair 23 (the third transport state), the control unit 26 uses the downstream eccentricity correction table 52 relating to the output roller pair 23 to control the ink discharge timing. According to the control, it is possible to more effectively suppress the banding on the recording surface of the medium.

Case in which Transport Roller Pair and Output Roller Pair Transport Separate Sheets of Paper In the printer 1, in a case in which the recording is performed consecutively on a plurality of sheets of the paper P, in order to increase the speed of the recording, there is a case in which, while a leading medium P1 which is transported first is in a recording region A of the line head 10, a following medium P2 is also fed to the recording region A of the line head 10 and the recording is performed on both sheets of paper (the leading medium P1 and the following medium P2) (refer to FIG. 10).

In FIG. 10, both the leading medium P1 which is transported by the output roller pair 23 (the downstream transport mechanism) and the following medium P2 which is transported by the transport roller pair 22 (the upstream transport mechanism) are positioned in the recording region A of the line head 10 and it is possible to record on both.

In this case, the control unit 26 may use the upstream correction table 28 (the upstream roller diameter correction table) to control the first drive source 24, may use the downstream correction table 29 (the downstream roller diameter correction table) to control the second drive source 25, may use the upstream eccentricity correction table 51 to control the discharge timing of the ink onto the following medium P2, and may use the downstream eccentricity correction table 52 to control the discharge timing of the ink onto the leading medium P1.

Accordingly, when performing the recording on both of the leading medium P1 which is transported by the output roller pair 23 and the following medium P2 which is transported by the transport roller pair 22 in the recording region A of the line head 10, it is possible to realize high-precision transporting with respect to both of the leading medium P1 and the following medium P2 and to suppress banding on both of the recording surfaces.

The suppression of the banding which originates from the kicking in the present embodiment is particularly effective in the case of a line head; however, for example, it is possible to adopt a configuration which is provided with a serial recording head which is mounted on a carriage and performs the recording by discharging a liquid onto a medium while moving reciprocally in a direction which intersects the medium transport direction.

Second Example

Figure 11:
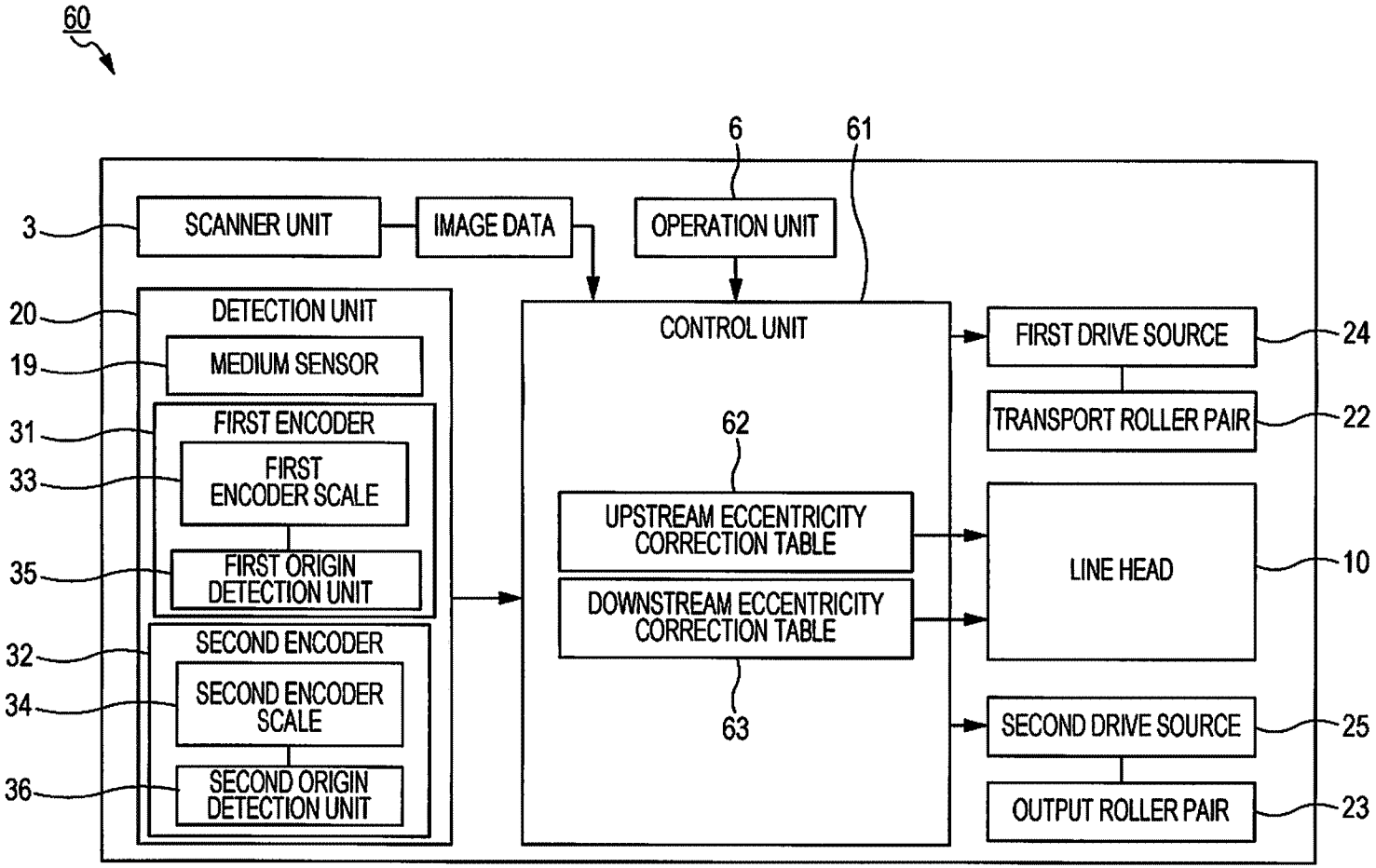
FIG. 11 is a block diagram illustrating the overall configuration of a printer according to a second example.

A description will be given of another example of a printer based on FIG. 11 in the second example. FIG. 11 is a block diagram illustrating the overall configuration of the printer according to the second example.

In the present example, the configuration which is the same as that of the first example is assigned the same reference numerals and the description thereof will be omitted.

A printer 60 according to the second example is provided with an upstream correction table 62 and a downstream correction table 63 which are referenced by the control unit 61 which controls the discharging of the ink (the liquid) from the line head 10. The upstream correction table 62 is used in the correction of the medium transport speed at the transport roller pair 22 and the downstream correction table 63 is used in the correction of the medium transport speed of the output roller pair 23.

The correction values which configure the upstream correction table 62 include at least a value for correcting the error in the medium transport speed which originates from the eccentricity of the rotating shaft of the upstream side drive roller 22*a*, and in the present embodiment, further include a value for correcting the error in the medium transport speed which originates from the error in the roller diameter of the upstream side drive roller 22*a*.

Similarly, the correction values which configure the downstream correction table 63 include at least a value for correcting the error in the medium transport speed which originates from the eccentricity of the rotating shaft of the downstream side drive roller 23*a*, and in the present embodiment, further include a value for correcting the error in the medium transport speed which originates from the error in the roller diameter of the downstream side drive roller 23*a*.

The control unit 61 determines which of the first transport state to the third transport state illustrated in FIGS. 5A to 5C a single sheet of the paper P is in based on the detection results of the medium detector such as the medium sensor 19. When the single sheet of the paper P is in the first transport state (FIG. 5A), the control unit 61 uses the upstream correction table 62 to control the ink discharge timing, when the single sheet of the paper P is in the second transport state (FIG. 5B), the control unit 61 uses at least one of the upstream correction table 62 and the downstream correction table 63 to control the ink discharge timing, and when the single sheet of the paper P is in the third transport state (FIG. 5C), the control unit 61 uses the downstream correction table 63 to control the ink discharge timing.

Since the upstream correction table 62 and the downstream correction table 63 are correction values which correct both the error in the medium transport speed which originates from the eccentricity of the rotating shaft (hereinafter referred to simply as the "error from eccentricity") and the error in the medium transport speed which originates from the error in the roller diameter (hereinafter referred to simply as the "error in the roller diameter") of the corresponding drive rollers (the upstream side drive roller 22*a* and the downstream side drive roller 23*a*), respectively, it is possible to correct by both the "error from eccentricity" and the "error in the roller diameter" and to suppress disturbances in the recorded image such as the banding which originates from the "error from eccentricity" and the "error in the roller diameter" by controlling the ink discharge timing of the line head 10.

In a case in which the nipping pressure of the transport roller pair 22 is set to be higher than the nipping pressure of the output roller pair 23, the control unit 61 may use the upstream correction table 62 to control the discharge timing of the ink when the paper P is in the second transport state (FIG. 5B).

In a case in which the nipping pressure of the transport roller pair 22 is set to be higher than the nipping pressure of the output roller pair 23, since the transporting of the paper P in the second transport state tends to be dominated by the behavior of the transport roller pair 22, it is possible to effectively suppress disturbances in the recorded image such as banding by using the upstream correction table 62 to control the discharge timing of the ink.

In each of the first example and the second example, a description is given of a medium transport device which is provided in a printer which is provided with a "recording head" as a "processing unit" which performs a process relating to the paper which is transported; however, in addition to the "recording head", the "processing unit" may be a "reading unit" which reads an image of the paper P. In the printer 1, the ink discharge timing of the line head 10 (the recording head) is controlled by the control unit 26; however, in an image reading apparatus which is provided with the "reading unit", for example, it is possible to adopt a configuration in which the image reading timing by the reading unit or the signal transmission timing at which the image data which is read by the reading unit is coded into a signal and transmitted is controlled.

The invention is not limited to the examples and may be modified in various ways within the scope of the invention described in the claims, and the modifications should be construed as being included in the scope of the invention.

For the correction tables, it is conceivable to measure the transport speed of the medium at the time of assembly of the printer 1, use the difference between the actual value and the theoretical value as a correction value, and store, the correction value in advance in a storage unit (not illustrated) of the printer 1. At this time, the correction tables may be prepared according to the types of medium.

The entire disclosure of Japanese Patent Application No. 2017-010936, filed Jan. 25, 2017 is expressly incorporated by reference herein.

What is claimed is:

1. A medium transport device comprising:

a processing unit which performs a process relating to a medium which is transported;

an upstream transport mechanism which is provided on an upstream side of the medium in a transport direction with respect to the processing unit;

a downstream transport mechanism which is provided on a downstream side in the transport direction with respect to the processing unit;

a first drive source which drives the upstream transport mechanism;

a second drive source which drives the downstream transport mechanism;

a medium detector which is provided on the upstream side in the transport direction with respect to the upstream transport mechanism and detects a position of an end portion of the medium in the transport direction; and a control unit which controls transporting the medium performed by the upstream transport mechanism and the downstream transport mechanism, wherein, based on detection results of the medium detector, the control unit determines a transport state from among a first transport state in which a single sheet of the medium is transported by the upstream transport mechanism and is not transported by the downstream transport mechanism, a second transport state in which the single sheet of the medium is transported by both the upstream transport mechanism and the downstream transport mechanism, and a third transport state in which the single sheet of the medium is transported by the downstream transport mechanism and is not transported by the upstream transport mechanism, and controls the first drive source and the second drive source based on a determination result of the transport state, the medium transport device further comprising an upstream correction table which is used in correction of a medium transport speed in the upstream transport mechanism, and a downstream correction table which is used in correction of the medium transport speed in the downstream transport mechanism, which are referred to by the control unit, wherein when the single sheet of the medium is in the second transport state, the control unit uses the upstream correction table to control the first drive source and uses the downstream correction table to control the second drive source so that each of the first drive source and the second drive source is controlled individually.

2. The medium transport device according to claim 1, wherein when a single sheet of the medium is in the first transport state, the control unit uses the upstream correction table to control the first drive source, and wherein when the single sheet of the medium is in the third transport state, the control unit uses the downstream correction table to control the second drive source.

3. The medium transport device according to claim 1, wherein the upstream transport mechanism is configured to include an upstream side drive roller which is driven by the first drive source and an upstream side driven roller which contacts the upstream side drive roller and is driven to rotate, wherein the downstream transport mechanism is configured to include a downstream side drive roller which is driven by the second drive source and a downstream side driven roller which contacts the downstream side drive roller and is driven to rotate, wherein a nipping pressure between the upstream side drive roller and the upstream side driven roller is set to be higher than a nipping pressure between the downstream side drive roller and the downstream side driven roller, wherein an upstream roller diameter correction table which is used in correction of an error in a medium transport speed which originates from an error in a theoretical value of a roller diameter of the upstream side drive roller, and a downstream roller diameter correction table which is used in correction of an error in a medium transport speed which originates from an error in a theoretical value of a roller diameter of the downstream side drive roller, which are referred to by the control unit, are provided, wherein when a single sheet of the medium is in the first transport state, the control unit uses the upstream roller diameter correction table to control the first drive source, wherein when the single sheet of the medium is in the second transport state, the control unit uses the upstream roller diameter correction table to control the first drive source, and wherein when the single sheet of the medium is in the third transport state, the control unit uses the downstream roller diameter correction table to control the second drive source.

4. The medium transport device according to claim 3, wherein the processing unit is a recording head which discharges a liquid to perform recording on the medium, wherein an upstream eccentricity correction table which is used in correction of an error in the medium transport speed which originates from eccentricity in a rotating shaft of the upstream side drive roller, and a downstream eccentricity correction table which is used in correction of an error in the medium transport speed which originates from eccentricity of a rotating shaft of the downstream side drive roller, which are referred to by the control unit, are provided, wherein when a single sheet of the medium is in the first transport state, the control unit which controls discharging the liquid from the recording head uses the upstream eccentricity correction table to control a discharge timing of the liquid, wherein when the single sheet of the medium is in the second transport state, the control unit uses the upstream eccentricity correction table to control the discharge timing of the liquid, and wherein when the single sheet of the medium is in the third transport state, the control unit uses the downstream eccentricity correction table to control the discharge timing of the liquid.

5. The medium transport device according to claim 4, wherein in a case in which recording is performed on both a leading medium which is transported by the downstream transport mechanism and a following medium which is transported by the upstream transport mechanism which are positioned in a recording region of the recording head, the control unit uses the upstream roller diameter correction table to control the first drive source and uses the downstream roller diameter correction table to control the second drive source, and the control unit uses the upstream eccentricity correction table to control the discharge timing of the liquid onto the following medium and uses the downstream eccentricity correction table to control the discharge timing of the liquid onto the leading medium.

6. The medium transport device according to claim 1, wherein the upstream transport mechanism and the downstream transport mechanism are transport roller pairs which nip and transport the medium or form a transport belt mechanism in which the medium is placed on a belt and transported.

7. The medium transport device according to claim 1, wherein the processing unit is a line recording head which discharges a liquid to perform recording on the medium.

8. The medium transport device according to claim 1, wherein the processing unit is a reading unit which reads an image of the medium.

9. A recording apparatus, comprising:

a recording head which discharges a liquid onto a medium which is transported to perform recording;

a transport roller pair which is provided on a medium transport direction upstream side of the recording head and includes an upstream side drive roller which is driven by a first drive source and an upstream side driven roller which contacts the upstream side drive roller and is driven to rotate;

an output roller pair which is provided on a medium transport direction downstream side of the recording head and includes a downstream side drive roller which is driven by a second drive source and a downstream side driven roller which contacts the downstream side drive roller and is driven to rotate;

a medium detector which detects a position of an end portion of the medium in a medium transport direction;

a control unit which controls discharging the liquid from the recording head; and an upstream correction table which is used in correction of a medium transport speed at the transport roller pair, and a downstream correction table which is used in correction of a medium transport speed at the output roller pair, which are referred to by the control unit, wherein correction values which configure the upstream correction table include a value for correcting an error in the medium transport speed which originates from eccentricity of a rotating shaft of the upstream side drive roller, and correction values which configure the downstream correction table include a value for correcting an error in the medium transport speed which originates from eccentricity of a rotating shaft of the downstream side drive roller, wherein, based on detection results of the medium detector, the control unit determines a transport state from among a first transport state in which a single sheet of the medium is transported by the transport roller pair and is not transported by the output roller pair, a second transport state in which the single sheet of the medium is transported by both the transport roller pair and the output roller pair, and a third transport state in which the single sheet of the medium is transported by the output roller pair and is not transported by the transport roller pair, and wherein when the single sheet of the medium is in the first transport state, the control unit uses the upstream correction table to control a discharge timing of the liquid, wherein when the single sheet of the medium is in the second transport state, the control unit uses either the upstream correction table or the downstream correction table to control the discharge timing of the liquid, and wherein when the single sheet of the medium is in the third transport state, the control unit uses the downstream correction table to control the discharge timing of the liquid.

10. The recording apparatus according to claim 9, further comprising:

an upstream roller diameter correction table which is used in correction of an error in a medium transport speed which originates from an error in a theoretical value of a roller diameter of the upstream side drive roller, and a downstream roller diameter correction table which is used in correction of an error in the medium transport speed which originates from an error in a theoretical value of a roller diameter of the downstream side drive roller, wherein when a single sheet of the medium is in the first transport state, the control unit which controls transporting the medium performed by the transport roller pair and the output roller pair uses the upstream roller diameter correction table to control the first drive source, wherein when the single sheet of the medium is in the second transport state, the control unit performs either control of the first drive source using the upstream roller diameter correction table or control of the second drive source using the downstream roller diameter correction table, and wherein when the single sheet of the medium is in the third transport state, the control unit uses the downstream roller diameter correction table to control the second drive source.

11. The recording apparatus according to claim 10, wherein a nipping pressure between the upstream side drive roller and the upstream side driven roller is set to be higher than a nipping pressure between the downstream side drive roller and the downstream side driven roller, and wherein when the medium is in the second transport state, the control unit performs either control of the discharge timing of the liquid using the upstream correction table or control of the first drive source using the upstream roller diameter correction table.

12. A medium transport device comprising:

a processing unit which performs a process relating to a medium which is transported;

an upstream transport mechanism which is provided on an upstream side of the medium in a transport direction with respect to the processing unit;

a downstream transport mechanism which is provided on a downstream side in the transport direction with respect to the processing unit;

a first drive source which drives the upstream transport mechanism;

a second drive source which drives the downstream transport mechanism;

a medium detector which is provided on the upstream side in the transport direction with respect to the upstream transport mechanism and detects a position of an end portion of the medium in the transport direction; and a control unit which controls transporting the medium performed by the upstream transport mechanism and the downstream transport mechanism, wherein, based on detection results of the medium detector, the control unit determines a transport state from among a first transport state in which a single sheet of the medium is transported by the upstream transport mechanism and is not transported by the downstream transport mechanism, a second transport state in which the single sheet of the medium is transported by both the upstream transport mechanism and the downstream transport mechanism, and a third transport state in which the single sheet of the medium is transported by the downstream transport mechanism and is not transported by the upstream transport mechanism, and controls the first drive source and the second drive source based on a determination result of the transport state, wherein the processing unit is a recording head which discharges a liquid to perform recording on the medium, wherein an upstream eccentricity correction table which is used in correction of an error in a medium transport speed which originates from eccentricity in a rotating shaft of the upstream side drive roller, and a downstream eccentricity correction table which is used in correction of an error in a medium transport speed which originates from eccentricity of a rotating shaft of the downstream side drive roller, which are referred to by the control unit, are provided, wherein when a single sheet of the medium is in the first transport state, the control unit which controls discharging the liquid from the recording head uses the upstream eccentricity correction table to control a discharge timing of the liquid, wherein when the single sheet of the medium is in the second transport state, the control unit uses the upstream eccentricity correction table to control the discharge timing of the liquid, and wherein when the single sheet of the medium is in the third transport state, the control unit uses the downstream eccentricity correction table to control the discharge timing of the liquid.

* * * * *